United States Patent [19]

Schrödter et al.

[11] Patent Number: 4,687,512

[45] Date of Patent: Aug. 18, 1987

[54] DESULFURIZING MIXTURE FOR METAL MELTS, PROCESS FOR MAKING IT, AND PROCESS FOR DESULFURIZING LIQUID METAL THEREWITH

[75] Inventors: Hermann Schrödter, Erftstadt; Albert Braun, Hürth; Friedrich-Wilhelm Kampmann, Erftstadt, all of Fed. Rep. of Germany

[73] Assignee: Hoechst Aktiengesellschaft, Fed. Rep. of Germany

[21] Appl. No.: 909,766

[22] Filed: Sep. 19, 1986

[30] Foreign Application Priority Data

Oct. 3, 1985 [DE] Fed. Rep. of Germany ..... 3535280

[51] Int. Cl.[4] ..... C21C 7/02

[52] U.S. Cl. ..... 75/58; 75/53; 75/257

[58] Field of Search ..... 75/53, 58, 257

[56] References Cited

U.S. PATENT DOCUMENTS

| | | | |
|---|---|---|---|
| 4,263,043 | 4/1981 | Haida | 75/58 |
| 4,274,869 | 6/1981 | Kristiansen | 75/58 |
| 4,391,633 | 7/1983 | Yamauchi | 75/58 |
| 4,541,867 | 9/1985 | Neelameggham | 75/58 |

*Primary Examiner*—Peter D. Rosenberg

*Attorney, Agent, or Firm*—Connolly and Hutz

[57] ABSTRACT

Mixture for desulfurizing metal melts based on calcium carbide, calcium oxide, alkaline earth metal carbonates, aluminum oxide, chemically unbonded carbon and alkali metal carbonates, if any. The desulfurizing mixture contains 0.3–4.5 wgt % calcium fluoride as an additional constituent and is produced by grinding the individual constituents jointly in a mill over a period of 3–30 minutes.

6 Claims, No Drawings

DESULFURIZING MIXTURE FOR METAL MELTS, PROCESS FOR MAKING IT, AND PROCESS FOR DESULFURIZING LIQUID METAL THEREWITH

The present invention relates to a mixture for desulfurizing metal melts based on calcium carbide, calcium oxide, alkaline earth metal carbonates, aluminum oxide, chemically unbonded carbon and alkali metal carbonates, if desired, and also to a process for making it and for desulfurizing liquid metal therewith.

The desulfurization of crude iron is gaining increasing interest due to the use of low grade iron ore and scrap in converters and the increasing use of coke or oil coke containing more sulfur. Only by desulfurizing the iron melt is it possible to provide the high grade steels poor in sulfur which are being increasingly used today.

Various attempts have already been made to provide the industry with efficient desulfurizing agents. The desulfurization just with lime has been tried but soon been given up as it is invariably necessary for this kind of desulfurization to have slag poor in FeO and to use high melt temperatures whereby silicon undergoes undesirable reduction at an increased rate. By the addition of calcium carbide, especially of calcium carbide extended with calcium oxide, it became possible for the metal melt to be treated at lower temperature.

German Specification No. DE-PS 20 37 758 describes a special grade calcium carbide and process, wherein a mixture of quicklime and fluor spar is introduced into the calcium carbide melt and solidified calcium carbide is ultimately crushed. The fact that only $\frac{2}{3}$ of the fluorine used remains in the melt is a disadvantage associated with this process.

German Specification No. DE-PS 26 42 838 describes a process for desulfurizing steel, wherein the metal melt is admixed under reduced pressure with a mixture of calcium carbide and 5–25 wgt % calcium fluoride. It has however turned out that this mixture should suitably not be added by means of a dipping lance as it is liable to cake together. In addition, slag encrustations are liable to form on the ladle walls. The desulfurizing mixture can however successfully be used whenever the metal bath is initially free from slag floating thereon.

The present invention now provides a desulfurizing mixture which can reliably be supplied in metered quantities through a dipping lance and permits metals, especially iron melts, such as crude iron, cast iron and steel melts to be very effectively desulfurized with formation of a friable slag. The invention also provides a process for making the desulfurizing mixture without evolution of off gas containing fluoride. The invention finally provides a method permitting the desulfurizing mixture to be reliably contacted with and injected into liquid metal.

The invention provides more particularly a mixture for desulfurizing metal melts based on calcium carbide, calcium oxide, alkaline earth metal carbonates, aluminum oxide, chemically unbonded carbon and alkali metal carbonates, if desired, the mixture containing from 0.3–4.5 wgt % calcium fluoride as an additional constituent, consisting of particles having a size of less than 0.5 mm, and being obtained by jointly grinding the constituents making the mixture in a mill over a period of 3–30 minutes, preferably 10–20 minutes.

The desulfurizing mixture of this invention is more specifically comprised of:

32–89 wgt % calcium carbide,
5–66 wgt % calcium oxide,
0.1–45 wgt % alkaline earth metal carbonate,
0.1–10 wgt % aluminum oxide,
0.1–10 wgt % (chemically unbonded) carbon, and
0.3–4.5 wgt % calcium fluoride.

The desulfurizing mixture preferably contains from 0.25–1.7 wgt % fluorine which should suitably be used in the form of fluor spar, and commercial carbide containing from 20–80 wgt % $CaC_2$.

It is immaterial whether use is made of commercial calcium carbide, the pure $CaC_2$-content of which was established inside the carbide furnace, or in liquid phase in a crucible by extending it with quicklime, or initially inside the carbide furnace and ultimately in liquid phase in the crucible by addition of quicklime.

The desulfurizing mixture should suitably be made using limestone and/or dolomite as the alkaline earth metal carbonates. It is finally preferable for the present desulfurizing mixture to contain up to 30 wgt % alkali metal carbonate, advantageously anhydrous sodium carbonate.

The process for making the desulfurizing mixture of this invention comprises grinding, over an average period of 3–30 minutes, preferably 10–20 minutes, a homogeneous mixture of the individual constituents having a particle size of 0.1–50 mm, preferably 0.2–20 mm, in a mill under dry inert gas to particles having a size of less than 0.5 mm. The grinding operation, especially the grinding period, has been found critically to determine the production of a mixture optimal as regards flowability and desulfurizing efficiency. Increasing the minimum grinding period of about 5 minutes to 10–20 minutes has been found to entail optimum results due to an increased tribochemical effect.

Inexpensive nitrogen should be used as the inert gas.

A preferred feature of the present process provides for at least 85 wgt % of the final product to be ground to particles having a size of less than 0.1 mm as the desulfurizing mixture so made can reliably be injected by means of a dipping lance and with the aid of a carrier gas into the liquid metal at a rate of 0.5–5.0 kg/ton metal.

The desulfurizing mixture of this invention permits iron melts, such as crude iron melts, cast iron melts and steel melts, to be more effectively desulfurized, based on the quantity of $CaC_2$ used, than heretofore.

As a result of its good flowability, the present desulfurizing mixture is substantially not liable to cake together, in the lance or in inlet openings of this latter. It has also been found that the walls of metal ladles remain substantially free from slag encrustation whenever use is made of the present desulfurizing mixture. As regards undesirable fluoride emission during desulfurization, the present mixture compares very favorably with calcium carbide/calcium fluoride-mixtures made in customary manner.

The following Examples illustrate the present processes for making and using the novel desulfurizing mixture of this invention.

EXAMPLE 1 (PREPARATION)

5000 kg/h of a mixture consisting of 80% commercial calcium carbide (particle size 7–15 mm, 34% $CaC_2$), 10% calcium carbonate (particle size 5–10 mm), 5% coke breeze (particle size smaller than 10 mm), 1.5% bauxite (particle size smaller than 0.3 mm) and 3.5% fluor spar (particle size 3–15 mm, 44% F) was ground under nitrogen in a tube mill (a product of Schriever & Co. company, type Hilda 1700). The average sojourn time of the material to be ground in the mill was 15 minutes.

The desulfurizing mixture so made was analyzed: particle size: 99.7% smaller than 0.5 mm; 90.1% smaller than 0.1 mm. The fluorine content of 1.5% corresponded to that in the raw materials.

EXAMPLE 2 (PREPARATION)

4000 kg/h of a mixture consisting of 70% commercial calcium carbide (particle size 7–15 mm; 34% $CaC_2$), 25% calcium carbonate (particle size 5–10 mm), 2.0% coke breeze (particle size less than 10 mm) and 3.0% fluor spar (particle size 3–15 mm; 44.0% F) was ground under nitrogen in a tube mill of the kind used in Example 1. The average sojourn time of the material to be ground in the mill was 20 minutes. The desulfurizing mixture so made was analyzed: particle size: 99.8% smaller than 0.5 mm; 90.1% smaller than 0.1 mm. The chemically analyzed desulfurizing mixture was found to contain 1.32% F, 2.3% $Al_2O_3$and 0.5% MgO. The MgO originated from the raw materials.

USE EXAMPLE 1

880 kg desulfurizing mixture prepared as described in preparation Example 1, corresponding to 2.5 kg desulfurizing mixture per ton crude iron, was injected over a period of 17 minutes through a dipping lance (immersion depth: 2.05 m) and with the aid of 20,000 liters dry nitrogen into a torpedo ladle filled with 350 tons liquid crude iron, at a melt temperature of 1392° C. The sulfur content initially of 0.06% was found to have been reduced to 0.005% S.

USE EXAMPLE 2

200 kg desulfurizing mixture prepared as described in preparation Example 2, corresponding to 1.3 kg desulfurizing mixture per ton of steel, was injected by means of a dipping lance (immersion depth=2.35 m) and with the aid of 4000 l argon into a metal ladle filled with 150 tons liquid steel, at a melt temperature of 1490° C.

The sulfur content initially of 0.024% was found to have been reduced to 0.0025% S.

USE EXAMPLE 3

400 kg of a desulfurizing mixture prepared as described in preparation Example 2, corresponding to 2.7 kg desulfurizing mixture per ton of steel, was injected by means of a dipping lance (immersion depth=2.35 m) and with the aid of 8000 liters argon into a metal ladle filled with 150 tons liquid steel, at a melt temperature of 1480° C.

The sulfur content initially of 0.025% was found to have been reduced to 0.0007% S.

We claim:

1. Process for making a desulfurization mixture containing calcium carbide, calcium oxide, calcium fluoride, alkaline earth metal carbonate, aluminum oxide, and chemically unbonded carbon, the mixture containing 0.3–4.5 weight-% calcium fluoride and consisting essentially of ground particles having a size of less than 0.5 mm, said process comprising:

jointly grinding the constituents of said desulfurization mixture in a mill over a period of 3 to 30 minutes under dry inert gas.

2. Process as claimed in claim 1, wherein the constituents making up the mixture are ground to particles with a size of less than 0.1 mm.

3. Process as claimed in claim 1, wherein the constituents making up the mixture are ground in the mill over a period of 10–20 minutes.

4. Process as claimed in claim 1, wherein the mixture is made using commercially pure calcium carbide.

5. Process as claimed in claim 1, wherein the mixture is made using calcium carbide extended with quicklime.

6. Process as claimed in claim 1, wherein the mixture contains, in addition to said constituents, an alkali metal carbonate.

* * * * *